United States Patent [19]

Konopa et al.

[11] Patent Number: 5,046,153

[45] Date of Patent: Sep. 3, 1991

[54] COIL TERMINAL CONNECTION

[75] Inventors: Richard L. Konopa; James E. Thompson, both of Anderson, Ind.

[73] Assignee: General Motors Corporation, Detroit, Mich.

[21] Appl. No.: 580,028

[22] Filed: Sep. 10, 1990

[51] Int. Cl.[5] ..... H01F 15/10

[52] U.S. Cl. ..... 336/192; 336/208; 439/751

[58] Field of Search ..... 439/751, 871, 872, 873, 439/825; 336/192, 198, 208, 185; 174/152 R

[56] References Cited

U.S. PATENT DOCUMENTS

| | | | |
|---|---|---|---|
| 3,076,165 | 1/1963 | Weyrich | 336/192 |
| 3,117,294 | 1/1964 | Muszynski | 336/192 |
| 3,315,198 | 4/1967 | Biesma et al. | 336/192 |
| 3,376,536 | 4/1968 | Bloom | 336/192 |
| 3,585,450 | 6/1971 | Lane | 336/192 |
| 4,003,128 | 1/1977 | Dochterman | 336/192 X |
| 4,246,562 | 1/1981 | Widemann et al. | 336/192 |
| 4,291,292 | 9/1981 | Witchger | 336/192 |
| 4,342,982 | 8/1982 | Plasko | 174/152 R |
| 4,575,167 | 3/1986 | Minter | 439/751 X |
| 4,588,973 | 5/1986 | Grah et al. | 336/192 |
| 4,853,667 | 8/1989 | Freimuth et al. | 336/192 |
| 4,918,419 | 4/1990 | Ida | 336/192 |

*Primary Examiner*—Thomas J. Kozma
*Attorney, Agent, or Firm*—Creighton R. Meland

[57] ABSTRACT

An electrical connection to a coil winding of a coil winding assembly that is comprised of a coil spool that carries the coil winding. The coil spool has an integral terminal supporting portion that is provided with an axially extending slot. A terminal, that can be formed of steel wire, has a rippled or undulated portion that is disposed within the slot. The rippled portion engages surfaces of said slot to prevent movement of the terminal out of the slot. An end portion of the coil is wrapped around a connector portion of the terminal and soldered thereto.

8 Claims, 2 Drawing Sheets

COIL TERMINAL CONNECTION

This invention relates to an electrical terminal connection to a coil of a coil winding assembly that is comprised of a coil spool formed of electrical insulating material that carries the coil.

It is well known to provide an electrical connection to the end of an electrical coil by connecting the end of the coil with a terminal that is supported by a coil spool or bobbin. Examples of such a construction are shown in the U.S. Pat. Nos. Biesma et al, 3,315,198, Davis 3,660,791, Buchschmid et al, 4,740,773, Friemuth et al, 4,853,667 and Grah et al, 4,588,973.

The coil terminating or terminal connection of this invention differs from the above-mentioned prior art in that, among other things, the terminal that is connected to the end of the coil is provided with a rippled or undulated portion that is disposed in a slot formed in a portion of the coil spool. The rippled portion has portions thereof that tightly engage internal surfaces of the slot to prevent the terminal from backing out of slot. The rippled portion acts as a spring to hold the terminal tight in the slot.

It accordingly is one object of this invention to provide an electrical connection for the end of a coil where the end of the coil is connected to a terminal that has a rippled portion that tightly fits in a slot formed in a portion of the coil spool.

Another object of this invention is to provide an electrical connection of the type described where the terminal has an electrical connector portion that is integral with the rippled portion and which is adapted to be connected to the end of the coil by wrapping the end of the coil around the connector portion and then soldering it to the connector portion. In carrying this object forward the connector portion extends through an opening that communicates with the slot and the connector portion lies in a plane that is substantially normal to the plane of the rippled portion.

IN THE DRAWINGS

In the description of this invention, a coil winding assembly that forms the secondary winding of an ignition coil will be described. It is to be understood, however, that the electrical connection of this invention can be used with coils other than the secondary coil of an ignition coil.

Figure 1:
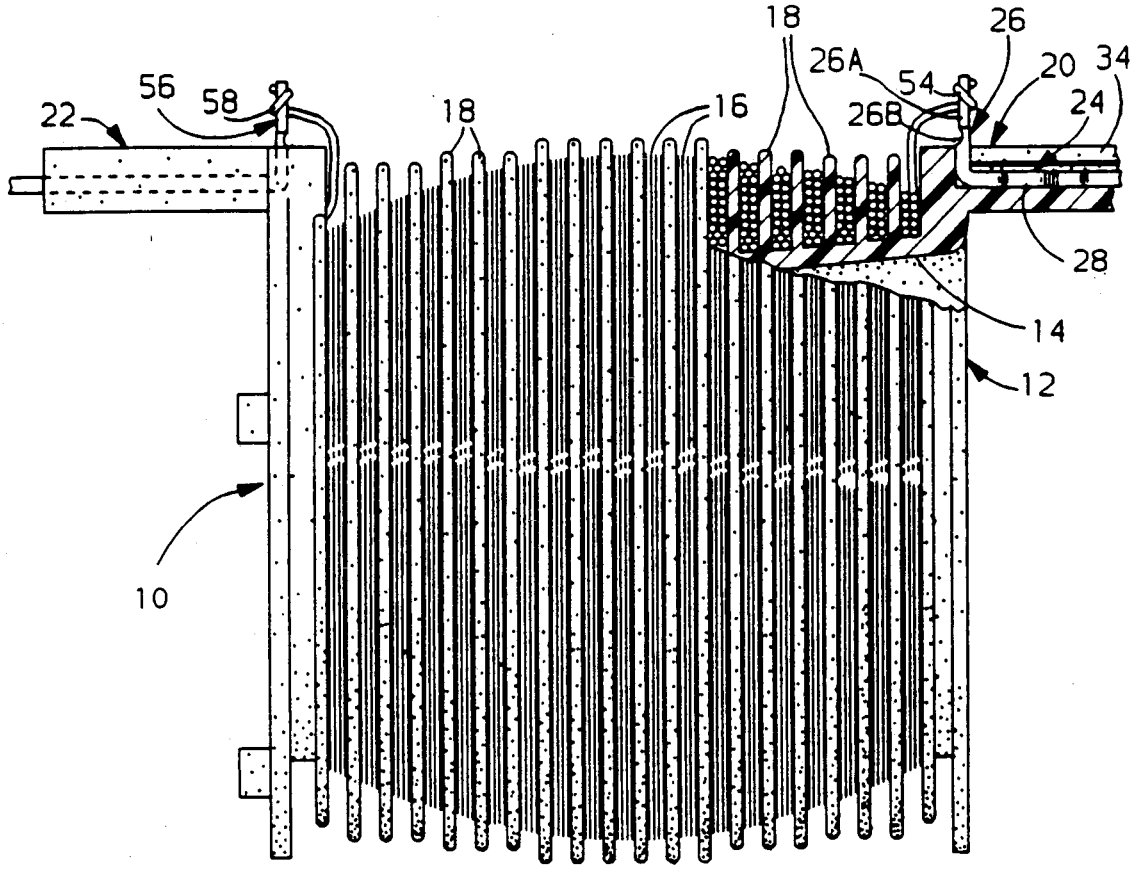
FIG. 1 is a side view, partly in section, of an electrical coil assembly that has a terminal connection made in accordance with this invention.

Referring now to the drawings and more particularly to FIG. 1, a secondary coil winding assembly for an ignition coil is illustrated which has been generally designated by reference numeral 10. The coil winding assembly comprises a spool or bobbin 12 which is formed of molded plastic electrical insulating material. The spool 12 has a central bore 14 which is adapted to receive the primary winding of an ignition coil. The coil spool 12 carries a secondary coil winding 16 comprised of a number of turns of No. 42 AWG copper wire. The coil winding 16 is made up of a number of axially spaced coil winding sections or segments that are disposed within axially spaced winding slots formed by axially spaced ribs 18.

The No. 42 wire that is used for coil 16 has a very small diameter which is about 0.0028 to 0.0032 inches. The diameter of this wire is shown much larger than this in the drawings. Further, the number of turns shown in the drawings is only exemplary. The actual number of turns that make up coil 16 may be about 11,000 turns.

The coil spool 12 has two slotted axially extending ribs 20 and 22 that each serve to support and retain a terminal in a manner to be described. The ribs 20 and 22 are integral with the coil spool 12.

The rib 20 supports and retains a terminal generally designated as 24. Terminal 24 is formed of a tin plated AISI 1008 steel round wire having a diameter of about 1.0mm. The terminal 24 has a connector portion 26 which has a portion 26A which is substantially square in cross-section and this portion is formed by subjecting the round wire to a forming operation. The four corners of this square cross-section portion 26A can be rounded by providing a slight radius at the corners. Connector portion 26 further has a recess 26B that facilitates the bending of portion 26A toward coil 16 in a manner that is more fully described hereinafter. The connector portion 26 is joined to a rippled or undulated portion 28 at bend 29. Portion 28 is comprised of a plurality of undulations. The wire that forms the rippled portion 28 is round in cross-section. Extending from the rippled portion 28 is another electrical connector portion 30 which is a straight round wire. The end of portion 30 is adapted to be connected to a terminal (not illustrated) of an ignition coil. Portion 30 may be about 40mm. long. It can be seen from the drawings that the rippled portion 28 lies in a plane that is substantially normal to the plane of connector portion 26.

The rib 20 has an axially extending slot 32 that communicates with or is joined by an axially extending opening 34 that extends along one side of rib 20. Slot 32 is defined by internal surfaces or walls 36, 38, 40, 42 and 44. Surfaces 42 and 44 are located adjacent the opening 34.

The terminal 24 is assembled to the slot by inserting it into slot 32. During this assembly, a part of connector portion 26 slides through opening 34.

Figure 3:
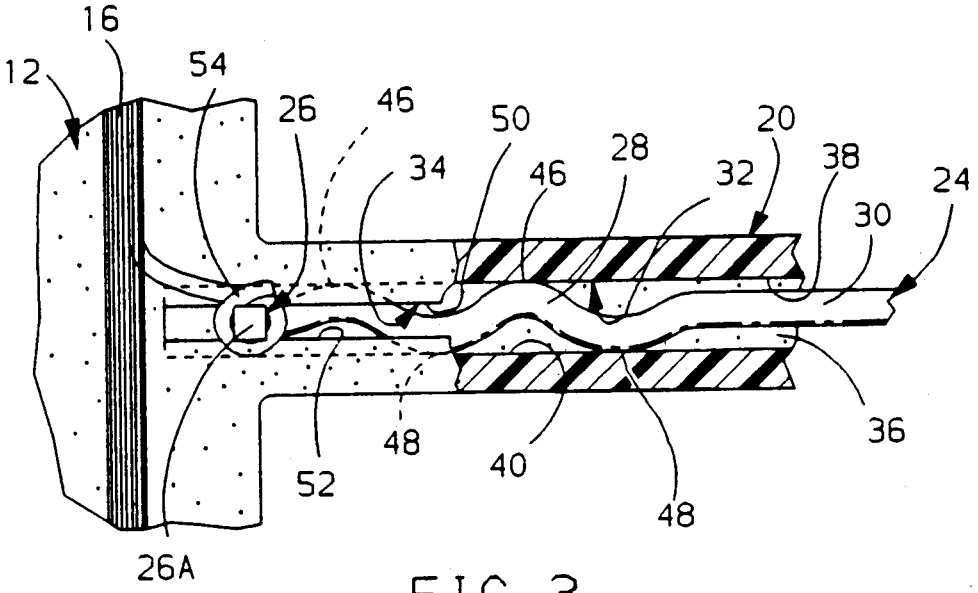
FIG. 3 is a view looking in the direction of arrows 3—3 of FIG. 2.
Figure 4:
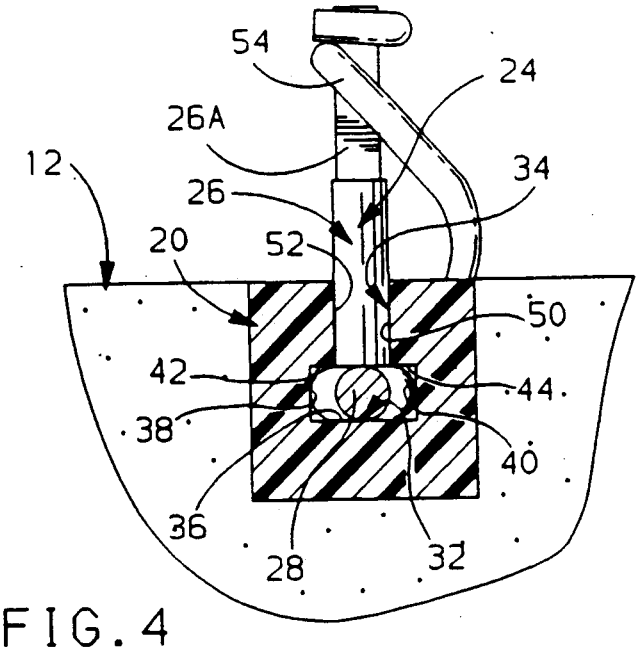
FIG. 4 is an enlarged sectional view taken along line 4—4 of FIG. 2.

The distance between laterally spaced points 46 and 48 of rippled portion 28 may be about 1.83 to 1.93mm. This distance is so related to the distance between surfaces 38 and 40 that points 46 and 48 of rippled portion 28 tightly engage opposed surfaces 38 and 40 as shown in FIG. 3. As the terminal 28 is inserted into slot 32, the undulations of rippled portion 28 can be compressed between surfaces 38 and 40 since the rippled portion acts as a spring. In the final assembled position of terminal 24, the spring action of rippled portion 28 causes it to tightly engage surfaces 38 and 40 thereby developing a frictional force that prevents terminal 24 from backing or moving out of slot 32.

The distance between slot surface 36 and slot surfaces 42 and 44 is slightly larger than the diameter of the wire that forms rippled portion 28. It will be appreciated that the rippled portion 28 is confined between surface 36 and surfaces 42 and 44 thereby preventing movement of terminal 24 in a direction normal to surface 36. Further, surfaces 36, 42 and 44 prevent any cocking of terminal 24.

The width of opening 34 between surfaces 50 and 52 is just large enough relative to the diameter of the wire of connector portion 26 to allow a lower part of connector portion 26 to slide therethrough when the terminal 24 is inserted into slot 32. Opening 34 acts to guide the movement of terminal 24 when it is inserted into slot 32. In the final assembled position of terminal 24, a part of connector portion 26 extends through opening 34. Any tendency of connector portion to move in directions normal to surfaces 50 and 52 is prevented by engagement of surfaces 50 and 52 with connector portion 26.

When the terminal 24 has been assembled to rib 20 an end portion of coil 16 is wrapped around and into contact with connector portion 26A. This wrapped around portion is designated by reference numeral 54. This wrapped around portion is then soldered to connector portion 26A. Although only one turn 54 has been illustrated, there may be as many as six turns wrapped on connector portion 26A.

Figure 2:
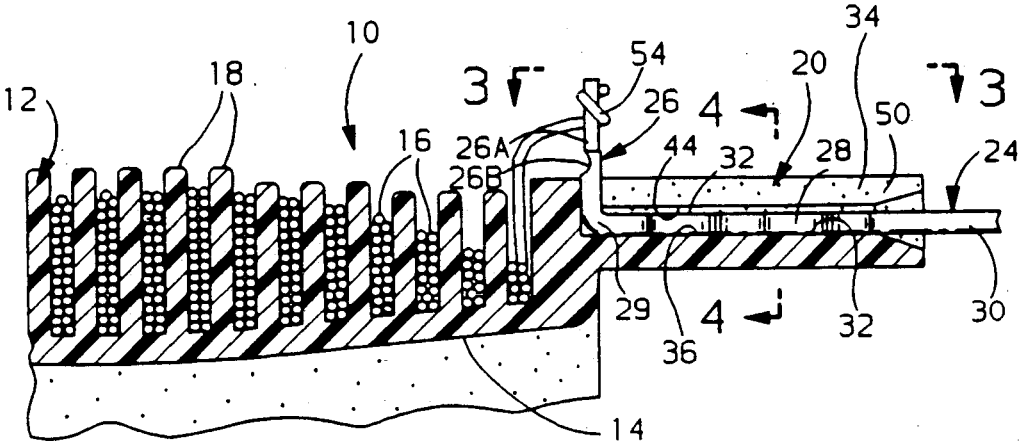
FIG. 2 is an enlarged view of a portion of FIG. 1.

After the end of coil 16 has been wrapped on connector portion 26A and soldered thereto, the connector portion 26A is bent or moved down toward coil 16 or, in other words, is bent counter-clockwise in FIG. 1. The bending or movement of portion 26A is facilitated by recess 26B and portion 26A pivots at recess 26B as portion 26A is moved toward coil 16. Portion 26A can be moved by about 75 degrees so that in the final position of connector portion 26A, it will be about 75 degrees from the position shown in FIGS. 1 and 2.

The rib 22 is identical with rib 20 and it carries a terminal 56 that is the same as terminal 24. The left end of coil winding 16 is wrapped around a portion of terminal 56. This is depicted by reference numeral 58. The wrapped around portion is soldered to a portion of terminal 56. This portion is then bent clockwise in FIG. 1 toward coil 16 by about 75 degrees.

The embodiments of the invention in which an exclusive property or privilege is claimed are defined as follows:

1. An electrical terminal connection to a coil of a coil winding assembly that has a coil spool formed of electrical insulating material that carries the coil comprising, a terminal supporting portion integral with said coil spool, said supporting portion having an axially extending so defined by a plurality of walls, a metallic terminal having a rippled portion and an electrical connector portion, said rippled portion having a sinuous shape and being defined by a plurality of axially spaced undulations, said undulations having alternately occurring outer surface portions that are respectively opposed and axially spaced, said rippled portion being disposed within said slot with said opposed and axially spaced outer surface portions engaging opposed walls of said slot to thereby oppose movement of said terminal in a direction axially of said slot, and means electrically connecting said coil to said connector portion.

2. An electrical terminal connection to a coil of a coil winding assembly that has a coil spool formed of electrical insulating material that carries the coil comprising, a terminal supporting portion integral with said coil spool, said supporting portion having an axially extending slot defined by first and second opposed pairs of walls, and a metallic terminal formed of wire having a rippled portion and an electrical connector portion, said rippled portion being disposed within said slot and engaging said first pair of opposed walls of said slot to thereby oppose movement of said terminal in a direction axially of said slot, said rippled portion being disposed beween said second pair of opposed walls to restrain movement of said terminal in a direction normal to said slot, and means electrically connecting said coil to said connector portion.

3. An electrical terminal connection to a coil of a coil winding assembly that has a coil spool formed of electrical insulating material that carries the coil comprising, a terminal supporting portion integral with said coil spool, said supporting portion having an axially extending slot defined by a plurality of walls, an axial and radially extending opening communicating with said slot located along one side of said supporting portion, and a metallic terminal having a rippled portion and an electrical connector portion, said rippled portion having a sinuous shape and being defined by a plurality of axially spaced undulations, said undulations having alternately occurring outer surface portions that are respectively opposed and axially spaced, said rippled portion being disposed within said slot with said opposed and axially spaced outer surface portions engaging opposed walls of said slot to thereby oppose movement of said terminal in a direction axially of said slot, said connector portion extending through said opening and supporting portion having wall means disposed adjacent said opening that overlie portions of said rippled portion to prevent movement of said terminal in the direction of said opening, and means electrically connecting said coil to said connector portion.

4. The terminal connection according to claim 3 where said rippled portion and connector portion are disposed in different planes.

5. The terminal connection according to claim 3 wherein said slot has a substantially rectangular cross-section.

6. The terminal connection according to claim 3 where said coil winding is the secondary winding of an ignition coil.

7. The terminal connection according to claim 3 where said supporting portion extends axially of an end portion of said coil spool.

8. An electrical terminal connection to a coil of a coil winding assembly that has a coil spool formed of electrical insulating material that carries the coil comprising, a terminal supporting portion integral with said coil spool, said supporting portion having an axially extending slot defined by a plurality of walls, an axial and radially extending opening communicating with said slot located along one side of said supporting portion, and a metallic terminal formed of steel wire having a rippled portion and an electrical connector portion, said rippled portion being disposed within said slot and engaging opposed walls of said slot to thereby oppose movement of said terminal in a direction axially of said slot, said connector portion extending through said opening, said supporting portion having wall means disposed adjacent said opening that overlie portions of said rippled portion to prevent movement of said terminal in the direction of said opening, and means electrically connecting said coil to said connector portion.

* * * * *